US011279578B2

(12) United States Patent
Mas Cano

(10) Patent No.: US 11,279,578 B2
(45) Date of Patent: Mar. 22, 2022

(54) DEVICE FOR FEEDING A SHEET PRODUCT

(71) Applicant: European Machinery Engineering Projects, S.L., Alicante (ES)

(72) Inventor: Eduardo Mas Cano, Alicante (ES)

(73) Assignee: European Machinery Engineering Projects, S.L., Alicante (ES)

( * ) Notice: Subject to any disclaimer, the term of this patent is extended or adjusted under 35 U.S.C. 154(b) by 0 days.

(21) Appl. No.: 16/786,209

(22) Filed: Feb. 10, 2020

(65) Prior Publication Data

US 2020/0255237 A1 Aug. 13, 2020

(30) Foreign Application Priority Data

Feb. 12, 2019 (ES) ..... ES201930221U

(51) Int. Cl.
*B65H 3/08* (2006.01)
*B65H 31/32* (2006.01)

(52) U.S. Cl.
CPC ..... *B65H 3/0816* (2013.01); *B65H 3/0883* (2013.01); *B65H 31/32* (2013.01)

(58) Field of Classification Search
CPC .... B65H 3/0816; B65H 3/0883; B65H 3/128; B65H 3/443; B65H 31/32
See application file for complete search history.

(56) References Cited

U.S. PATENT DOCUMENTS 4,002,332 A * 1/1977 Hoenigmann ..... B65H 3/0816 271/11
4,349,189 A * 9/1982 Edstrom ..... B65H 1/04 198/456
4,391,439 A * 7/1983 Edstrom ..... B65H 1/04 221/13
2008/0061492 A1* 3/2008 Zwettler ..... B65H 3/0816 271/20
2015/0321864 A1* 11/2015 Gallucci ..... B65H 3/0816 271/3.08

* cited by examiner

*Primary Examiner* — Thomas A Morrison
(74) *Attorney, Agent, or Firm* — The Webb Law Firm

(57) ABSTRACT

A device for feeding sheet products into a thick sheet feeding machine including an insertion gantry, a feed carriage sliding on rails. The device includes an insertion head configured as a gantry. The insertion head includes a crosspiece and support legs positioned on the rails and a system of suction cups located in the crosspiece through a forward movement mechanism allowing the system to move. The device includes an insertion module moving vertically on guides of the insertion gantry, a base for placing the sheets, and an alignment control device for aligning the sheets with respect to the insertion module. The sheets are suctioned by the suction cups, which are moved by the forward movement mechanism in the direction of the insertion gantry.

2 Claims, 3 Drawing Sheets

DEVICE FOR FEEDING A SHEET PRODUCT

CROSS-REFERENCE TO RELATED APPLICATION

This application claims priority to Spanish Utility Model Application No. U201930221 filed Feb. 12, 2019, the disclosure of which is hereby incorporated by reference in its entirety.

BACKGROUND

Field

The present invention relates to a device for feeding a sheet product that is able to convert a thick sheet feeder into a universal feeder, valid both for thick sheets and for thin sheets, with the subsequent economic and space savings.

Description of Background Art

Sheet feeding machines have the function of supplying sheets to a device in which, for example, the sheet will be marked or a box will be formed. Furthermore, they also have the function of squaring the sheets, i.e., supplying them such that they are positioned with respect to a given reference. To that end, not only do the machines have to be able to feed the sheets to the device in an individual manner, but furthermore, the sheets must be fed such that they are aligned in the same position, i.e., squared and with a uniform clearance between them.

In the current state of the art, despite being able to be divided into smaller groups depending on specific functions, sheet feeding machines are generally differentiated in two main types according to the thickness of the sheet, which are those machines for feeding a thin sheet, with thicknesses less than 1 mm, fed from the upper area of the formed stack, and those machines for feeding a thick sheet, with thicknesses greater than 1 mm, and fed from the lower area of the formed stack. This differentiation in terms of the type of product is fundamental, since the type of feeding machine works in a completely different manner.

For this reason, despite the fact that the activities in which the two types of sheets are used may seem to be very different, a company dedicated to graphic arts and/or press forming is likely to work with the two types of sheet thicknesses, that is, thick and thin, so such company cannot get by without having one type of the two groups of machines.

This entails an economic cost in terms of acquisition of the machine and also in terms of the space needed for it, which often creates significant problems since two different production lines are needed.

To be able to clearly understand why these two types of machines are not unified in a single machine, the operation of each must be explained in order to clearly see the main differences between these two types of feeding machines.

In a thin sheet feeding machine, the machine includes the following basic elements:

- A base where a stack of sheets to be treated is supported.
- An insertion module, included in an insertion gantry, the outlet area for the sheets exiting the feeding machine, in charge of suctioning the sheets.
- Rails located on walls transversely demarcating the base and connecting with the insertion gantry.
- A row of suction cups fixed to the crosspiece of a gantry-shaped insertion head and pneumatically fed for taking up the top sheet of the stack by vacuum and positioning it so as to be suctioned by the insertion module.
- An alignment device for aligning the stack of sheets with respect to the insertion module as the stack of sheets is gradually used up.

In a thick sheet feeding machine, the difference is based on the following:

- The sheets cannot be suctioned by suction cups due to their weight and dimensions, whereby the sheets are supplied to the insertion module from the bottom.
- The stack of sheets is supported at the front end in the outlet area for the sheets, where there is an insertion system in contact with same responsible for suctioning the sheets.
- The back end is supported on a carriage responsible for later holding the sheets which, together with the support of the front end, configures a base, so there is no surface acting as a base and no lifting mechanism for the stack of sheets is needed as they are supplied from the bottom.

SUMMARY

The present invention includes a sheet feeding machine with the ability to work with any sheet thickness, providing the mentioned savings in terms of cost and space for companies in the sector.

For the purpose of meeting the objectives and avoiding the drawbacks mentioned above, the present invention describes a device for feeding sheet products into a thick and thin sheet feeding machine comprising an insertion gantry, a feed carriage with the ability to slide along a pair of rails located on respective walls, and comprising an insertion head, an insertion module and a base where a stack of sheets to be treated is located.

The insertion head is configured by a gantry comprising a crosspiece and support legs positioned on the rails, in addition to a system of suction cups located in the crosspiece with capacity to move, the system of suction cups being connected to a pneumatic circuit.

The insertion module can move vertically on guides located in the insertion gantry.

The system of suction cups can suction a sheet when positioned above it by means of a vacuum generated by a pneumatic circuit to which it is connected.

The system of suction cups with has the ability to move in the direction of the insertion gantry.

Furthermore, the alignment of the stack of sheets with the insertion module can be adjusted in height by means of adjusting the position of the insertion module, or also by locating the base on a lifting mechanism such that, either way, the top sheet of the stack is aligned with the sheet inlet of the insertion module.

Lastly, the device can also include a lifting system for conveying the insertion head and positioning it on the rails, where it can include a mobility mechanism which can be hydraulically or also electrically activated by means of a button panel, for example. This provides comfort and versatility when working on changing sheet activity.

BRIEF DESCRIPTION OF THE DRAWINGS

To complete the description of the invention and for the purpose of helping to better understand its features according to a preferred embodiment thereof, a set of drawings is attached in which the following figures are depicted in an illustrative and non-limiting manner.

Figure 1:
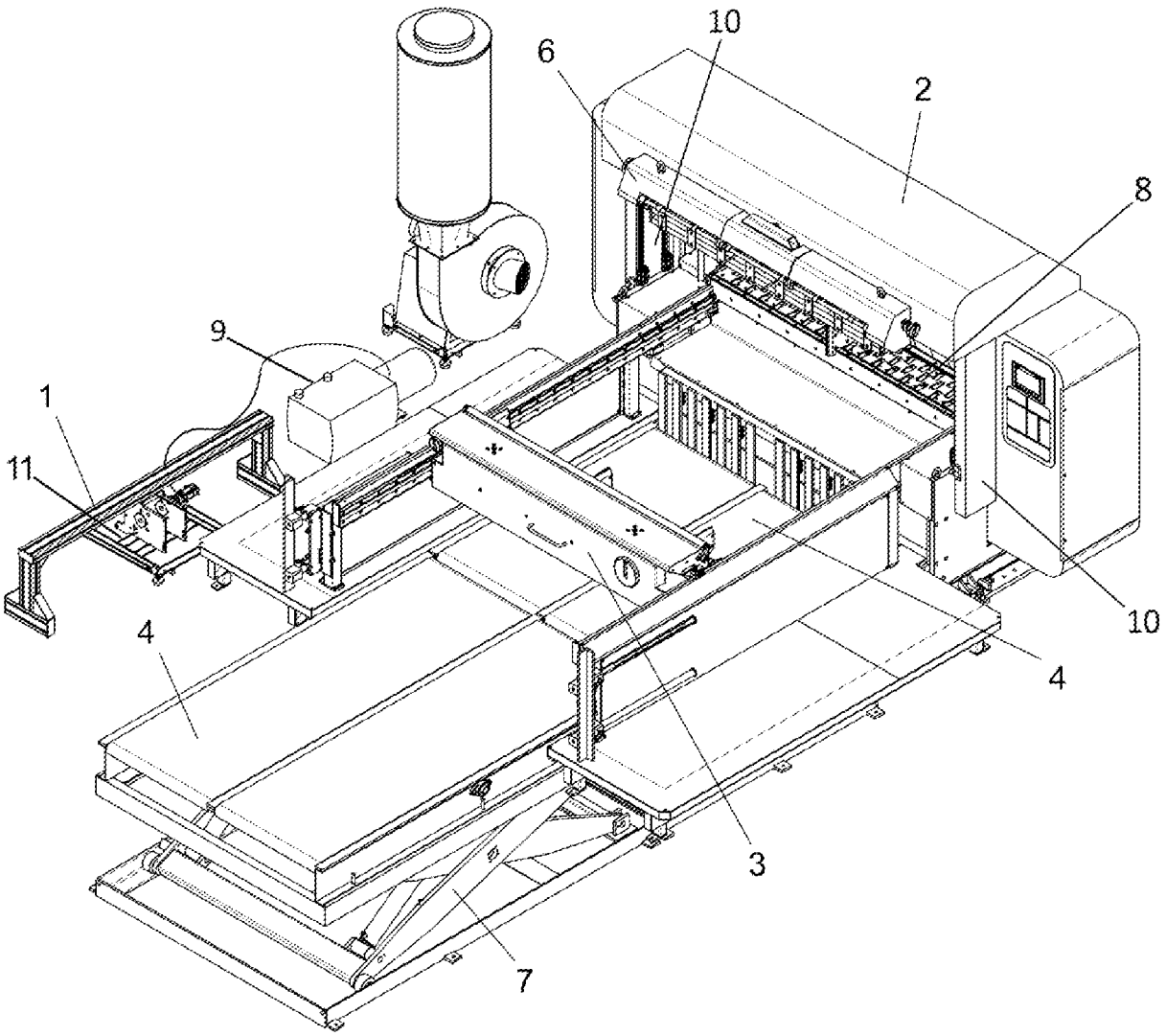
FIG. 1 depicts a top perspective view of a thick sheet feeding machine with the insertion head disassembled and where an insertion gantry and a base supported on a lifting mechanism have already been included.

A list of the references used in the figures is provided below:

1. Insertion head.
2. Insertion gantry.
3. Feed carriage.
4. Base.
5. Rails.
6. Insertion module.
7. Lifting mechanism.
8. Suction system.
9. Pneumatic circuit.
10. Guides of the insertion gantry.
11. System of suction cups.

DETAILED DESCRIPTION

The present invention relates to a device for feeding a sheet product whereby a thick sheet feeding machine is transformed into a thin sheet feeding machine. With this device, the need to have two sheet feeding machines as well as two production lines, one for thin sheets and another one for thick sheets, is thereby prevented.

The device of the invention includes the implementation, in a thick sheet feeding machine, referred to as base machine, of a series of elements of a thin sheet feeding machine, such that the base machine is transformed into a feeding machine for any type of sheets, regardless of the thickness.

The device of the invention includes at least three elements.

The first element includes an insertion head (1) which includes a system of pneumatically fed suction cups (11) responsible for picking up the thin sheets from the stack and supplying them, as will be described in detail below, to the second element, which is an insertion module (6) housed in the insertion gantry (2) in charge of removing the sheets from the machine. The third element is a base (4) for supporting the stack of sheets with the particular feature that it includes a lifting mechanism (7) on which it is supported for lifting and vertically positioning the stack of thin sheets.

Thus, by positioning the insertion head (1) in the base machine with the system of suction cups (11), the insertion module (6) on the insertion gantry (2) and the base (4) with the lifting mechanism (7), it is possible to use the base machine as a thick or thin sheet feeding machine.

FIG. 1 depicts a thick sheet feeding base machine with the feed carriage (3) that can slide on rails (5) located on walls longitudinally flanking the positioning area of the stack of sheets.

An insertion head (1), which is disassembled, an insertion module (6) in the insertion gantry (2), located in a top area in a standby state, and a base (4) with the lifting mechanism (7), have been included in this base machine.

In the base machine, in order to adjust the feeding of the stack of thick sheets, the front end of the stack of sheets is positioned in the insertion gantry on a suction system (8) and the front end is positioned in the feed carriage (3), such that a base (4) is not needed for supporting the sheets, since the sheets provide the necessary rigidity. The suction system (8) is activated for suctioning the sheets and moving them out of the feeding machine. In order to prevent several sheets from being suctioned at the same time, the insertion gantry (2) includes a panel adjusted to a height of the base through which slide the sheets which is somewhat greater than the thickness of a sheet, whereby assuring that only the bottom sheet can move and the sheets are fed in an individual manner.

However, this type of configuration does not work for thin sheet feeding machines, since these sheets do not present the rigidity needed for being able to move with the stack of sheets on same, so they must be suctioned from the top area.

To that end, the device of the invention is used, which device, as indicated above, includes at least three elements: an insertion head (1), an insertion module (6) and a base (4) with a lifting mechanism (7).

The insertion head (1) is configured by a gantry comprising a crosspiece and support legs positioned on the rails (5) of the side walls in a location between the feed carriage (3) and the insertion gantry (2), i.e., in a position that will be located on the stack of thin sheets to be treated. To that end, it is important to assure that the feed carriage (3) has been positioned at the end farthest away from the insertion gantry (1) to prevent it from interfering in the process.

Figure 2:
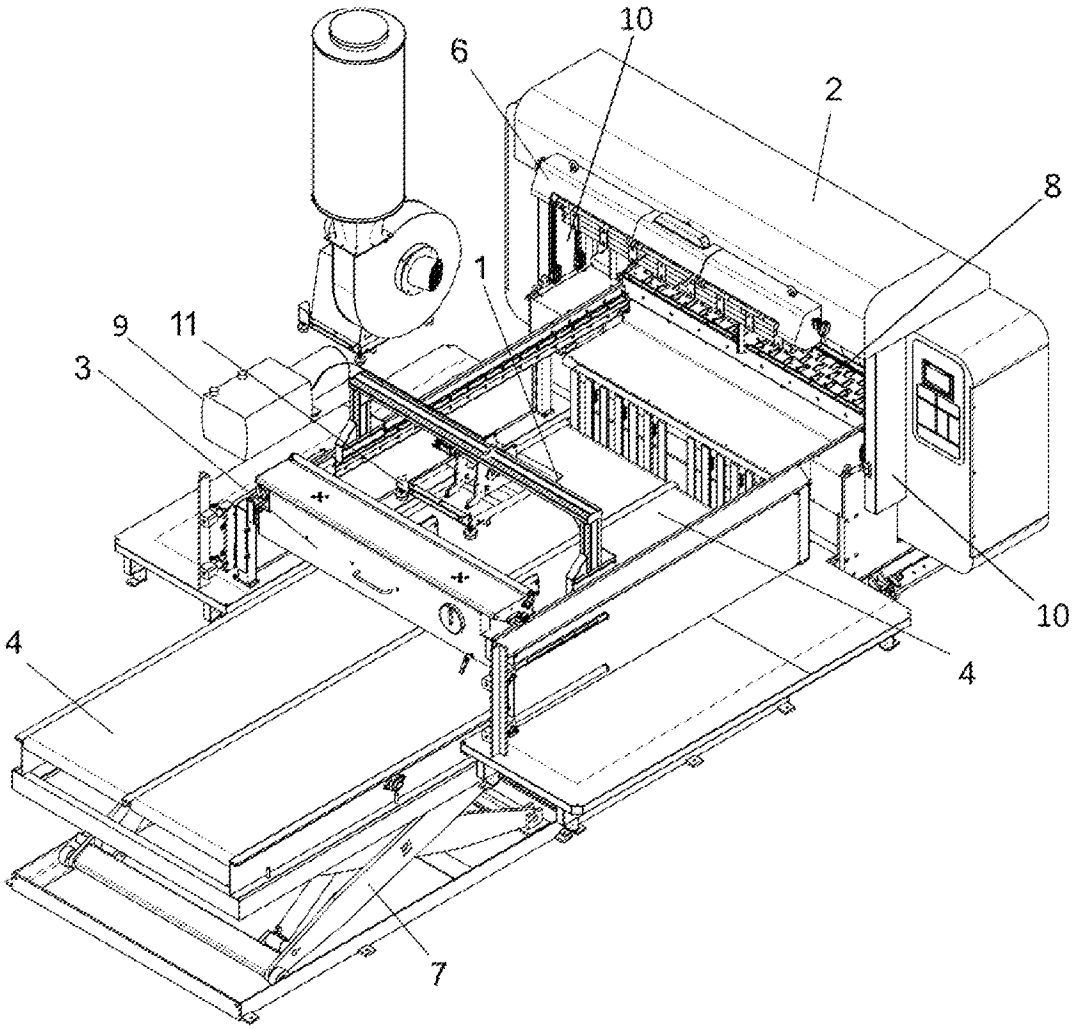
FIG. 2 depicts a later transformation step of the feeding machine of FIG. 1, where the feed carriage has been located in a back position to avoid interferences, and the insertion head has been assembled on the rails of the insertion gantry.

The insertion head (1) is then placed on the rails (5) at a distance from the insertion gantry similar to the length of the thin sheets to be treated. This configuration is depicted in FIG. 2.

Preferably, the device also includes a lifting system, such as a crane or pulley, not depicted in the figures, for placing the insertion head (1) on the rails (5), such that the assembly and disassembly can be carried out by a single operator in a practical and operative manner. So as to be easier to use, this lifting system can include an electrically activated mobility mechanism, activated by means of a button panel, for example.

The insertion module (6) is located in the insertion gantry (2) such that it can move vertically along respective side guides (10). It is initially positioned in the top part of the insertion gantry (2), such that it does not interfere when the machine is used as a thick sheet feeding machine. To be operative in this new configuration for thin sheets, the insertion module (6) moves vertically until being located at the height of the sheet inlet, i.e., at the height where the sheet suction system (8) of the insertion gantry (2) is located.

The insertion head (1) includes, in the crosspiece, a system of suction cups (11) intended for taking up the sheets of the stack by suction, by activating a vacuum through a pneumatic system (9). The system of suction cups (11) is fixed to the insertion head (1) which allows it to have slight forward movement which, once the sheet has been suctioned by the suction cups (11), helps the sheet move towards the insertion module (6).

Figure 3:
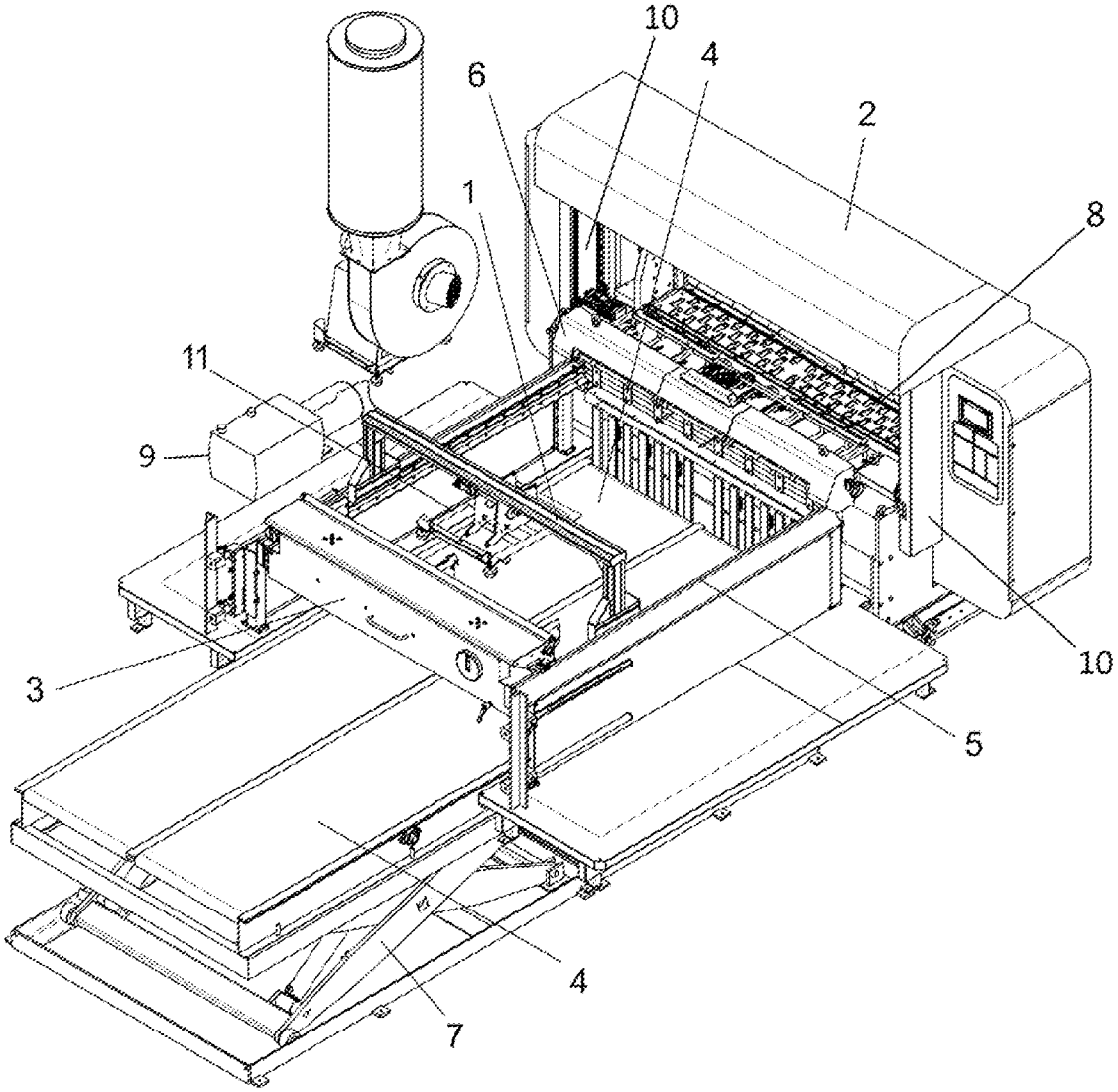
FIG. 3 depicts the final transformation step of the thick sheet feeding machine, where the insertion module of the insertion gantry has been lowered to its working position.

Therefore, once the feed carriage (3) has been withdrawn backwards so as to not interfere with the operation of the feeding machine, the insertion head (1) has been located on the rails (5) and the insertion module (6) has been positioned at the appropriate height, the base (4) is positioned between the side walls, inserting the stack of thin sheets, and lifted to the appropriate working height by means of activating the lifting mechanism (7). This is the final configuration of the base machine adapted as a thin sheet feeding machine and depicted in FIG. 3.

The sheets are fed by means of suction through the suction cups (11) on the top sheet of the stack in the rear area, carrying out a slight forward movement by means of the insertion head (1) in order to insert the front end into the insertion module (6) until it is taken up by the suction mechanism included therein, the vacuum of the suction cups (11) then being eliminated for the free movement of the sheet and the suction cups (11) moving back to the initial position in order to suction the next sheet.

It must be taken into account that the base (4) is gradually lifted up as the stack of sheets is gradually reduced, such that the position in height of the top sheet of the stack is maintained.

Optionally, the base (4) may not include the lifting mechanism (7). The alignment of the stack of sheets with the insertion module (6) is then performed by adjusting the position of the insertion module (6) in height as the stack of sheets is gradually used up. This option can be used because the position of the insertion module (6) is already controlled for selecting the initial alignment position with respect to the stack of sheets, whereby later alignment control is only an additional configuration, which may entail saving on the lifting mechanism (7).

Lastly, it must also be considered that the present invention should not be limited to the embodiment herein described. Other configurations can be carried out by persons skilled in the art in view of the present description. Accordingly, the scope of the invention is defined by the following claims.

The invention claimed is:

1. A device for feeding sheet products and to be incorporated into a sheet feeding machine comprising an insertion gantry, a feed carriage configured to slide along a pair of rails of the feeding machine, and a suction system in charge of suctioning sheets of a stack from a bottom, wherein the device comprises:

an insertion head configured as a gantry comprising:

a crosspiece and support legs positioned on the rails; and a system of suction cups being connected to a pneumatic circuit;

an insertion module configured to move vertically on guides located in the insertion gantry, a base for locating a stack of sheets to be treated, and an alignment control device for aligning the stack of sheets with respect to the insertion module wherein:

the system of suction cups is configured to suction a sheet when positioned above the sheet through a vacuum generated by the pneumatic circuit to which the system of suction cups is connected, and the insertion head provides the system of suction cups with the ability to move in a direction of the insertion gantry, the sheet feeding machine being configured to supply the insertion module with thick sheets taken from the bottom of the stack, and also with thin sheets taken from the top of the stack.

2. The device for feeding sheet products according to claim 1, wherein the alignment control device for aligning the stack of sheets with respect to the insertion module is a lifting mechanism on which the stack of sheets is located.

* * * * *